US009611523B2

(12) United States Patent
Yoshihara

(10) Patent No.: US 9,611,523 B2
(45) Date of Patent: Apr. 4, 2017

(54) COLD FORMABLE SPRING STEEL WIRE EXCELLENT IN COLD CUTTING CAPABILITY AND FATIGUE PROPERTIES AND MANUFACTURING PROCESS THEREOF

(75) Inventor: Nao Yoshihara, Kobe (JP)

(73) Assignee: Kabushiki Kaisha Kobe Seiko Sho (Kobe Steel, Ltd.), Kobe-Shi (JP)

( * ) Notice: Subject to any disclaimer, the term of this patent is extended or adjusted under 35 U.S.C. 154(b) by 1764 days.

(21) Appl. No.: 11/559,654

(22) Filed: Nov. 14, 2006

(65) Prior Publication Data

US 2007/0137741 A1 Jun. 21, 2007

(30) Foreign Application Priority Data

Dec. 20, 2005 (JP) ..... 2005-366760

(51) Int. Cl.

| | |
|---|---|
| ***C21D 9/02*** | (2006.01) |
| ***C22C 38/34*** | (2006.01) |
| ***C22C 38/04*** | (2006.01) |
| ***C22C 38/18*** | (2006.01) |

(52) U.S. Cl.

CPC ..... *C22C 38/34* (2013.01); *C22C 38/04* (2013.01)

(58) Field of Classification Search

None

See application file for complete search history.

(56) References Cited

U.S. PATENT DOCUMENTS

| | | | | |
|---|---|---|---|---|
| 5,085,733 | A * | 2/1992 | Mitamura | 148/319 |
| 6,206,984 | B1 | 3/2001 | Inada et al. | |
| 6,338,763 | B1 | 1/2002 | Hashimura et al. | |
| 6,372,056 | B1 | 4/2002 | Kuroda et al. | |
| 2003/0201036 | A1* | 10/2003 | Hashimura et al. | 148/333 |
| 2005/0173028 | A1 | 8/2005 | Suda et al. | |
| 2006/0225819 | A1 | 10/2006 | Yoshihara | |

FOREIGN PATENT DOCUMENTS

| | | |
|---|---|---|
| EP | 0 943 697 A1 | 9/1999 |
| EP | 1 612 287 A1 | 1/2006 |
| EP | 1 698 712 A1 | 9/2006 |
| EP | 1 712 653 A1 | 10/2006 |
| JP | 63-153240 | 6/1988 |

(Continued)

OTHER PUBLICATIONS

Totten et al (Totten et al , Handbook of Metallurgical Process Design, Marcel Dekker (2004).*

(Continued)

*Primary Examiner* — Yoshitoshi Takeuchi

(74) *Attorney, Agent, or Firm* — Oblon, McClelland, Maier & Neustadt, L.L.P.

(57) ABSTRACT

Disclosed is a cold formable spring steel wire excellent in cold cutting capability and fatigue properties, in which the steel wire satisfies given composition, has an average globular carbide particle size [√(ab)]:1.0 μm or less with aspect ratio (a/b, a: major axis of carbide, b: minor axis of carbide) being 2 or less, a ratio (area %) of the globular carbide in the steel: (0.1 to 3)×amount (mass %) of C in the steel, an amount (mass %) of Cr in the globular carbide: [0.4×amount (mass %) of Cr in the steel] or less, hardenability factor (Dic): between 110 mm and 450 mm, and tensile stress of 2000 MPa or more.

11 Claims, 3 Drawing Sheets

(56) References Cited

FOREIGN PATENT DOCUMENTS

| | | |
|---|---|---|
| JP | 11-6033 | 1/1999 |
| JP | 2002-180198 | 6/2002 |
| JP | 3453501 | 7/2003 |
| JP | 2004-216399 | 8/2004 |
| JP | 2004-300481 | 10/2004 |
| JP | 3627393 | 12/2004 |
| JP | 2006-183137 | 7/2006 |

OTHER PUBLICATIONS

U.S. Appl. No. 11/548,080, filed Oct. 10, 2006, Yoshihara, et al.
U.S. Appl. No. 11/538,703, filed Oct. 4, 2006, Yoshihara.

* cited by examiner

COLD FORMABLE SPRING STEEL WIRE EXCELLENT IN COLD CUTTING CAPABILITY AND FATIGUE PROPERTIES AND MANUFACTURING PROCESS THEREOF

BACKGROUND OF THE INVENTION

Field of the Invention

The present invention relates in general to a cold formable spring steel wire excellent in cold cutting capability and fatigue properties and a manufacturing process thereof, more specifically, to a spring steel wire having a superior cold cutting capability required for the manufacture of springs and good fatigue strength (endurance in air) as a significant spring property, and a manufacturing process of the spring steel wire. Although a spring steel of the present invention is useful in manufacture of springs for use in diverse fields inclusive of the transportation field such as automobiles, ships and the like, and the industrial machinery, it is assumed that the present invention steel is used as a material of parts in an automobile as a typical example.

Description of the Related Art

The chemical compositions of spring steels are specified in JIS G 3565 to 3567, JIS G 4801 and the like. By use of these spring steels, various cold formable springs can be manufactured by the steps of, that is, after hot rolling a steel material satisfying the above-described chemical composition: (A) drawing the rolled material to a specified diameter without performing an annealing (softening) process; (B) drawing the material after annealing (softening); and (C) cutting the surface after annealing (softening), and heating and drawing. When the drawing process is completed as above, a spring steel wire is quenched and tempered, being formed into a spring with a predetermined tensile strength. The spring steel wire is then wound by a cold forming coiling machine and each piece is generally cold cut by a shear. Furthermore, in order to remove distortions in the wound springs, annealing is performed at a low temperature, and the surface of the wires is hardened through shot peening and/or nitriding.

There have been strong demands toward the enhancement of the stress of a spring as a part of measures of achieving small and light springs in order to reduce exhaust gas or fuel consumption. For example, there is required of a high strength spring steel wire of which tensile strength after quenching and tempering is 2000 MPa or greater.

As a technology related to the cold formable steel wire, Japanese Patent Gazette No. 3453501 suggests that balance of the composition should be controlled in order to obtain steels for cold winding with small residual stress generated during a bending process.

Meanwhile, as the strength of a spring increases, the sensitivity against defects is generally increased. Also, even insignificant defects that do not necessarily affect fatigue properties, such as, minor defects caused during transportation or wire drawing defects present on the surface of the spring steel wire, accelerate propagation of fatigue cracks around the location during a cold shear cutting process. However, controlling the balance of the composition as disclosed in the above-described technique is not sufficient to suppress cracks at the time of cold shear cutting.

Many technologies for suppressing cracks during cold shear cutting have been suggested. One of them is Japanese Patent Gazette No. 3627393, which indicates that the cause of cold shear cracks is high notching susceptibility. Thus, to decrease the notching susceptibility, it teaches to control average particle size of carbides or volume ratio of carbides in the steel. However, according to this technology, Si content is limited to below 1.5 mass % because Si is known to deteriorate workability. Ironically though, it is very difficult to achieve a tensile strength higher than 2000 MPa with that amount of Si. Therefore, the above-described technology cannot increase the cold cutting capability in a high strength region nor enhance the fatigue property that is a significant feature for a spring.

SUMMARY OF THE INVENTION

It is, therefore, an object of the present invention to provide a spring steel wire and a manufacturing process thereof, which are useful for the manufacture of a spring featuring an excellent cold cutting capability during the manufacture and superior fatigue properties.

To achieve the above objects and advantages, there is provided a spring steel wire, containing:

C: 0.45-0.70% ("%" herein means "mass %"),

Si: 1.9-2.5%

Mn: 0.15-1.0%, and

Cr: 0.7-2.0%, wherein:

P: 0.015% or less (exclusive of 0%);

S: 0.015% or less (exclusive of 0%);

Cr+Si: 3.0% or more;

Cr/Si: 0.95 or less;

wherein the metallic structure of the steel satisfies:

an average globular carbide particle size [√(ab)]: 1.0 μm or less with aspect ratio (a/b, a: major axis of carbide, b: minor axis of carbide) being 2 or less;

a ratio (area %) of the globular carbide in the steel: (0.1 to 3)×amount (mass %) of C in the steel;

an amount (mass %) of Cr in the globular carbide: [0.4×amount (mass %) of Cr in the steel] or less;

tensile stress: 2000 MPa or more; and hardenability (quenchability) factor (Dic) represented by the following formulas (1)-(3): 110 mm≤Dic≤450 mm, <In Case that C Content is not Less than 0.45% Nor Greater than 0.55%>

$$Dic = 25.4 \times (0.171 + 0.001[C] + 0.265[C]^2) \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]) \quad (1)$$

<In Case that C Content is Greater than 0.55% but not Greater than 0.65%>

$$Dic = 25.4 \times (0.115 + 0.268[C] - 0.038[C]^2) \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]), \text{ and} \quad (2)$$

<In Case that C Content is Greater than 0.65% but not Greater than 0.70%>

$$Dic = 25.4 \times (0.143 + 0.2[C] \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]) \quad (3)$$

(in which, [C], [Mn], [Si], [Ni], [Cr], [Cu], and [V] represent an amount (mass %) of each element in the steel.)

In an exemplary embodiment of the invention, the spring steel wire may further contain (in mass %) (a) at least one element selected from a group consisting of V: 0.4% or less, Ti: 0.1% or less and Nb: 0.1% or less, or (b) at least one element selected from a group consisting of Cu: 0.70% or less and Ni: 0.80% or less.

Another aspect of the invention provides a manufacturing process of the spring steel wire, which the process includes the steps of: hot rolling a steel material that satisfies the above-described composition; setting a cooling starting temperature after hot rolling to 900° C. or higher, and cooling the steel material from the cooling starting temperature down to 700° C. at a cooling rate of 10° C./sec or higher; and annealing the steel material at a temperature range of 550° C. to 700° C.

In addition, the average globular carbide particle size [√(ab)] with aspect ratio (a/b, a: major axis of carbide, b: minor axis of carbide) being 2 or less, the ratio (area %) of the globular carbide in the steel, and the amount (mass %) of Cr in the globular carbide are measurement values obtained from experimental examples (to be described).

The spring steels of the present invention, when used for the manufacture of springs used in an automobile for example, exhibit an excellent cold cutting capability. Accordingly, the present invention is particularly useful in the field where superior fatigue properties and good workability are required, for instance, valve springs of the internal combustion engines or clutch springs, brake springs, stabilizers, torsion bars, and suspension springs of automobiles.

Additional and/or other aspects and advantages of the present invention will be set forth in part in the description which follows and, in part, will be obvious from the description, or may be learned by practice of the invention.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

In order to realize a spring steel wire with enhanced cold cutting capability and fatigue properties after spring forming in a high strength area of 2000 MPa or higher, the inventors have conducted a number of experimental verifications to discover any factor in an increase of notching susceptibility that causes deteriorations in the cold cutting capability. As the result of much efforts, the inventors found out that to manufacture spring steel wires excellent in the cold cutting capability and fatigue properties after spring forming in a high strength area, it is very important to control the shape of globular carbide particles existing in the steel (hereinafter referred to simply as "globular carbides") having an aspect ratio (a/b, a: major axis of carbide, b: minor axis of carbide) of 2 or less (to be more specific, a ratio of an average particle size of the globular carbides to a content of the globular carbides in the steel), balancing amounts of Cr and Si, and a hardenability factor (Dic) of a steel material that influences the structure of a hot rolled wire material, and came to a conclusion as follows:

(1) The cold cutting capability can be improved by reducing an average particle size [√(ab)] of globular carbides of which aspect ratio in the steel (a/b, a: major axis of carbide, b: minor axis of carbide) is 2 or less;

(2) The cold cutting capability (cold shear cutting capability) can be improved by controlling a ratio of the globular carbides (area %) in the steel to a certain range;

(3) The cold cutting capability and the strength can be improved by controlling an amount of Cr forming the globular carbides to a certain range;

(4) High strength can be achieved by setting a sum of the amount of Cr and the amount of Si in the steel to a certain value or higher;

(5) Both cold cutting capability and strength can be improved by limiting a ratio of the amount of Si in the steel to an amount of Cr in the steel to a certain value or less; and (6) By controlling a hardenability factor (Dic) of the steel material to fall within a certain range, a ratio of the globular carbides in the steel exceeds the lower limit set forth in the present invention.

The following will now explain in detail the control of the shape of carbide, the balancing of amounts of Cr and Si in the steel, and the control of a hardenability factor (Dic) of the steel material as set forth in the conditions (1)-(6) described above.

<Average Particle Size of Globular Carbides in the Steel: 1.0 μm or Less>

Figure 1:
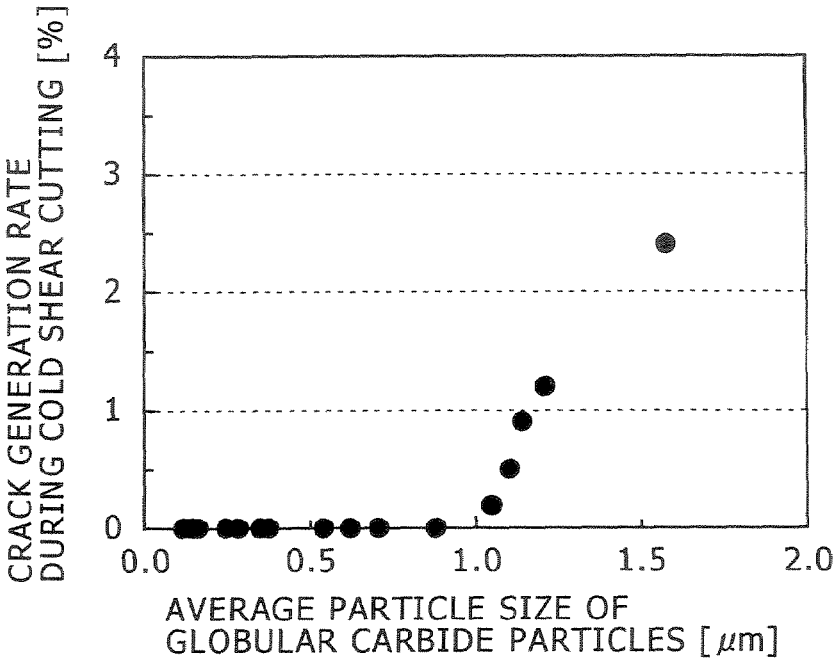
FIG. 1 is a graph showing the relation between an average particle size of globular carbide particles and a crack generation rate during cold shear cutting.

When a steel wire has a martensite structure (to be described), notching susceptibility is increased at the presence of large carbides in the structure, leading to significant deterioration of cold cutting capability. FIG. 1 is a graph showing the relation between an average particle size of the globular carbides and a crack generation rate during cold shear cutting, and summarizes test results obtained from experimental examples (to be described). According to FIG. 1, the crack generation rate during cold shear cutting becomes zero if the average particle size of the globular carbides is set to 1.0 μm or less. In addition, the average particle size of the globular carbides is obtained by SEM observation (×2000), which will be described later, and a target to be measured is a globular carbide particle of which particle size (√(ab)) is 0.05 μm or more within an observable magnification.

<Ratio (Area %) of Globular Carbides in the Steel: (0.1 to 3)×Amount (Mass %) of C in the Steel>

Similar to the case where coarse or rough globular carbides are present in the steel, if the ratio of globular carbides in the steel increases, the notching effect by the carbides is easily increased and more cracks are produced during cold shear cutting. Moreover, if the ratio of the globular carbides in the steel is high, toughness of the steel wire deteriorates, giving rise to another problem such as cracks in the longitudinal direction from an end section besides the cracks during shear cutting. Cracks in the longitudinal direction from an end section are cracks that are formed from the cut end portion in an axial direction of the steel wire. When those cracks occur, fatigue damages may progress from the end portion of a spring during use of the spring.

Figure 2:
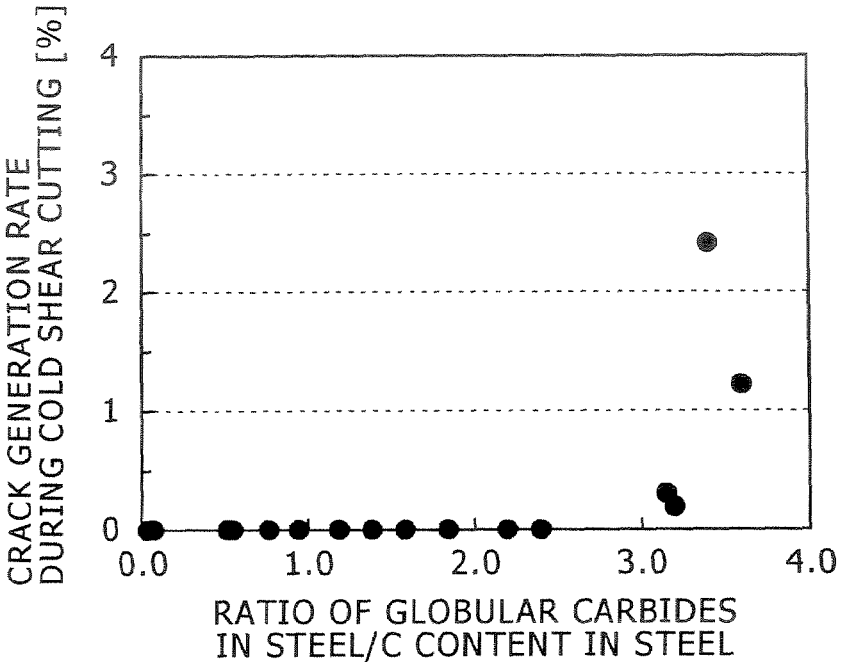
FIG. 2 is a graph showing the relation between (a ratio of globular carbides in a steel/C content in a steel) and a crack generation rate during cold shear cutting.

FIG. 2 is a graph showing the relation between (a ratio of globular carbide in the steel/C content in the steel) and a crack generation rate during cold shear cutting, and summarizes test results obtained from experimental examples (to be described). According to FIG. 2, the crack generation rate during cold shear cutting may become absolutely zero when the ratio of globular carbides in the steel/C content in the steel is 3 or below, that is, when the ratio of globular carbides in the steel is (3×C content in the steel) area % or less.

Figure 3:
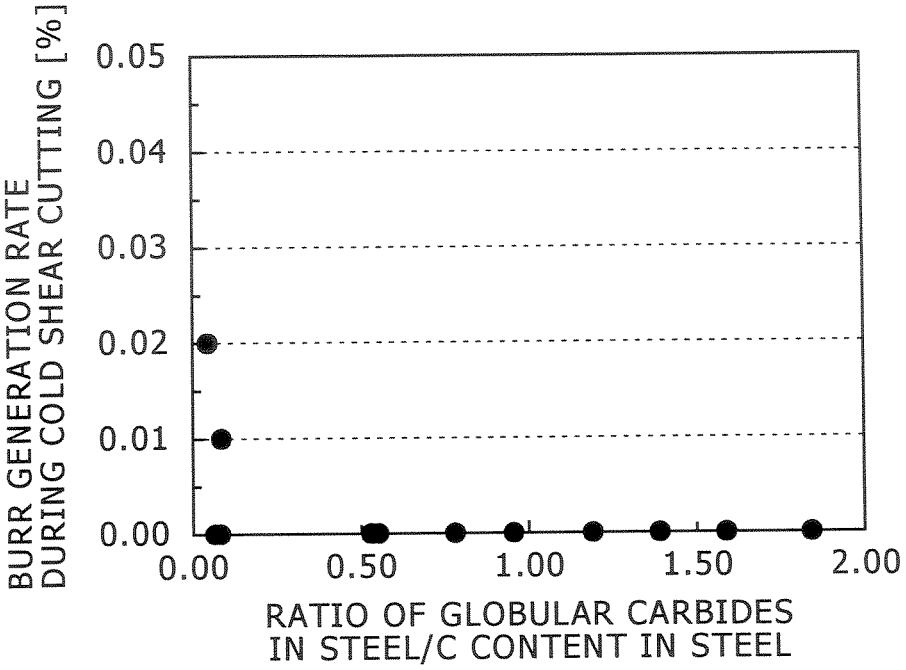
FIG. 3 is a graph showing the relation between (a ratio of globular carbides in a steel/C content in a steel) and a burr generation rate during cold shear cutting.

Meanwhile, carbide is a propagation path of cracks during shear cutting and serves to enhance the cold cutting capability. Thus, if an amount of the carbide is too little, burr is more likely to be generated during cold shear cutting. FIG. 3 is a graph showing the relation between (a ratio of globular carbides in the steel/C content in the steel) and a burr generation rate during cold shear cutting, and summarizes test results obtained from experimental examples (to be described). According to FIG. 3, the burr generation rate during cold shear cutting may become absolutely zero when the ratio of globular carbides in the steel/C content in the steel is 0.1 or more, that is, when the ratio of globular carbides in the steel is (0.1×C content in the steel) area % or more.

<Amount (Mass %) of Cr Forming Globular Carbides: [0.4×Cr Content (Mass %) in the Steel] or Less>

Carbide containing Cr is hard, shows a large difference of hardness between matrix structures of steel materials, and acts as a propagation path of cracks during cold shear cutting. Thus, it is very difficult to cut the Cr-containing carbide perpendicularly to the axial direction during cold cutting. In addition, this may cause cracks in the longitudinal direction from an end section. Moreover, in order to achieve high strength through tempering-hardening with respect to the quenching and tempering, it is necessary to secure soluble Cr. However, if Cr content in the globular carbides is too high, high strength is hard to achieve. Thus, in the present invention, the upper limit of Cr content in the globular carbides was limit to (0.4×Cr content in the steel) mass %, preferably, (0.3×Cr content in the steel) mass %.

In addition, for the present invention steel wire containing at least 1.0% of Cr, the lower limit of the Cr content in the globular carbides becomes (0.005×Cr content in the steel) mass %, provided that the ratio of the carbides in the steel was set to (0.1×C content in the steel) area % or higher as described above.

However, one thing to notice about the Cr content forming the globular carbides in the steel is that it is influenced by the amount of Cr in the steel. That is, if the amount of Cr in the steel increases, the amount of Cr forming the globular carbides is likely to increase as well. Furthermore, if the cooling starting temperature (temperature for placing on a Stelmor conveyor, for example) after hot rolling is too high, the amount of Cr forming the globular carbides tends to decrease. Also, when a cooling rate from the cooling starting temperature (above 900° C.) down to 700° C. is high, the amount of Cr forming the globular carbides is reduced. In addition, if the temperature for an annealing process after hot rolling is increased, the amount of Cr forming the globular carbides tends to increase. Therefore, such a factor in the amount of Cr forming the globular carbides was limited to fall within a range set by the present invention. In this manner, it was possible to control the amount of Cr forming the globular carbides in the steel to lie within the set range.

<Cr+Si: 3.0% or More>

<Cr/Si: 0.95 or Less>

As aforementioned, Cr is an element that easily forms a carbide in the steel, and is also an essential element for crystallization of the carbide. However, if annealing is carried out at a temperature higher than the recrystallization temperature (about 500° C.) yet below $Ac_1$ transformation temperature, globulization/coarsening of the carbide is accelerated. When carbides become coarse or rough, cracks originated by the carbides occur more easily during cold shear cutting, they are not easily dissolved by heating when even an austenite structure area is quenched, and a desired tensile strength is not obtained. Therefore, there is a limit for obtaining a high strength spring only by controlling the amount of Cr.

On the other hand, Si is a ferrite forming element while suppressing the formation of carbides, and is essential for crystallization of carbides. Thus, by using Cr and Si together, one can increase tensile strength without necessarily having to generate the coarse carbides.

Figure 4:
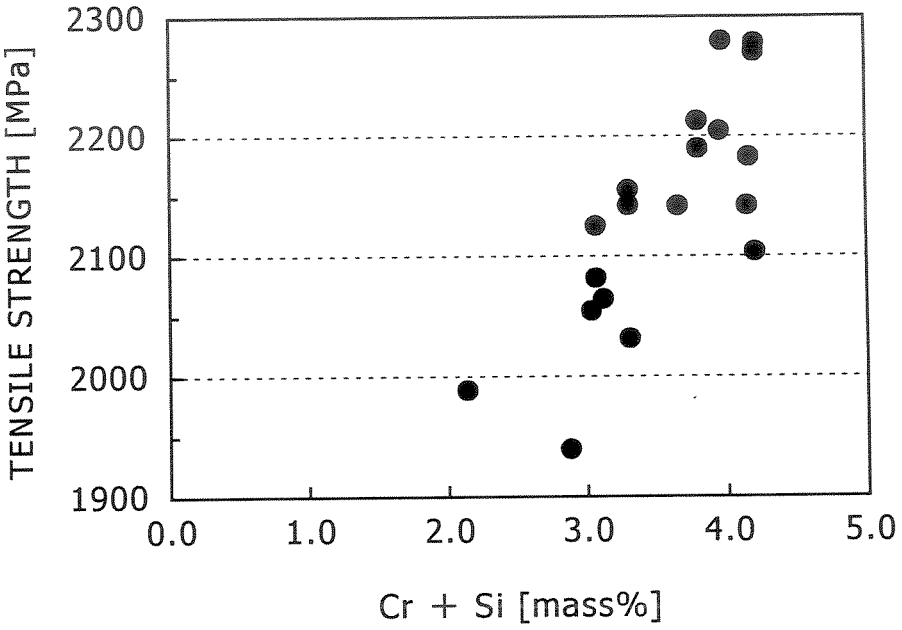
FIG. 4 is a graph showing the relation between (Cr+Si) and tensile strength.

FIG. 4 is a graph showing the relation between (Cr+Si) and tensile strength. According to FIG. 4, in order to increase the tensile strength of 2000 MPa or higher, a total amount of Cr and Si needs to be greater than 3.0%. Thus, to get the tensile strength of 2000 MPa or higher, although this will be detailed later, the content of Cr was set to 0.7% or more and the content of Si was set to 1.9% or more, giving at least 3.0% of Cr and Si contents in total. To increase the tensile strength above 2100 MPa, the total amount of Cr and Si should also be increased to 3.5% or more.

As explained before, Cr is a carbide forming element, while Si is a ferrite forming element. In other words, Cr tends to promote the carbide formation, while Si tends to suppress the carbide formation. Therefore, by controlling the ratio of Si content in the steel with respect to Cr content in the steel, increase in the amount of carbides formed by Cr and the production of the coarse carbides can be suppressed, leading to enhancement in the cold cutting capability.

Figure 5:
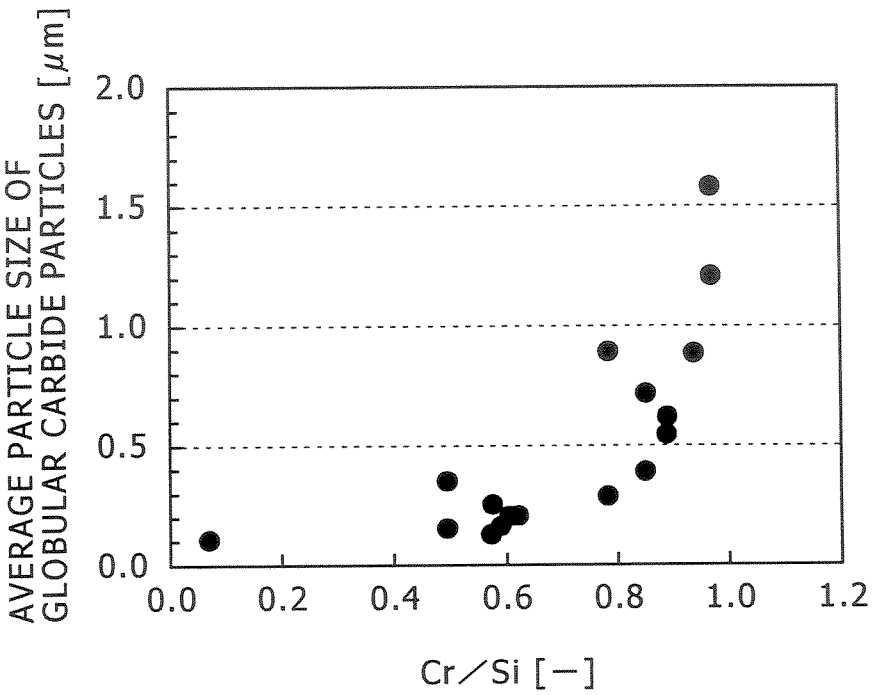
FIG. 5 is a graph showing the relation between (Cr/Si) and an average particle size of globular carbide particles.

FIG. 5 is a graph showing the relation between (Cr/Si) and an average particle size of the globular carbides. According to FIG. 5, in order to suppress the average particle size of the globular carbides to 1.0 μm or less, the ratio of Cr to Si needs to be 0.95 or less.

Figure 6:
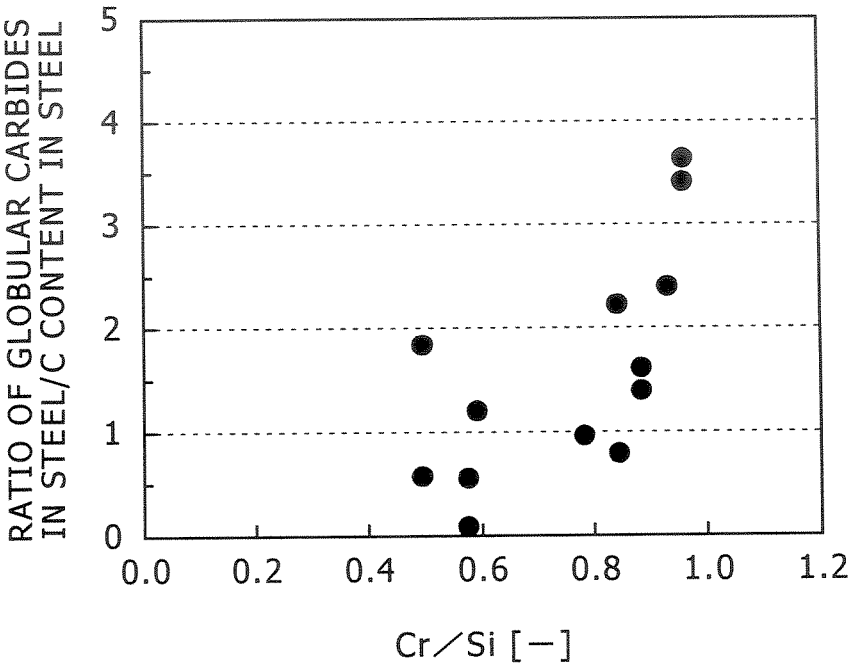
FIG. 6 is a graph showing the relation between (Cr/Si) and (a ratio of globular carbide in a steel/C content in a steel).

Lastly, FIG. 6 is a graph showing the relation between (Cr/Si) and (a ratio of globular carbides in the steel/C content in the steel). According to FIG. 6, in order to reduce the ratio of globular carbides in the steel to C content in the steel to 3 or less, namely, to reduce the ratio of the globular carbides in the steel to (3×C content in the steel) area % or less, it is necessary to set the ratio of Cr to Si to 0.95 or less.

<Hardenability Factor (Dic) Shown in Formulas (1)-(3): 110 Mm≤Dic≤450 mm>

The hardenability factor (Dic) of the following formulas (1)-(3) indicated by C contents is an index of forming tendency of a supercooling structure such as martensite or bainite in a hot rolling. In a high alloy composition related to high strength steel wire, this index tends to be high.

Considering that, during an annealing process after hot rolling, structures form carbides more readily in order of martensite, bainite, and pearlite, a structure to be annealed after hot rolling needs to be composed mainly of martensite (50% or more, preferably 70% or more) so that carbides can be produced to a certain degree during the annealing process after hot rolling. In this manner, the amount of carbides in the steel, even though the steel needs to go through processes that reduce the carbide content (e.g., heat treatment like a quenching process) can be within the set range. To precipitate martensite, the hot roller supercooling structure, the value of Dic must be increased. Thus, in the present invention, the lower limit of Dic was to 110 mm, preferably 115 mm or more, to get the desired martensite structure under given cooling conditions after hot rolling. However, if Dic is too high, quench cracks are generated more easily during quenching and tempering. Thus, the present invention set the upper limit of Dic to 450 mm, preferably 420 mm or less.

<In the Case where the C Content is not Less than 0.45% Nor Greater than 0.55%>

$$Dic = 25.4 \times (0.171 + 0.001[C] + 0.265[C]^2) \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]) \quad (1)$$

<In Case that C Content is Greater than 0.55% but not Greater than 0.65%>

$$Dic = 25.4 \times (0.115 + 0.268[C] - 0.038[C]^2) \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]), \text{ and} \quad (2)$$

<In the Case where the C Content is Greater than 0.65% but not Greater than 0.70%>

$$Dic = 25.4 \times (0.143 + 0.2[C] \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]) \quad (3)$$

(in which, [C], [Mn], [Si], [Ni], [Cr], [Cu], and [V] represent an amount (mass %) of each element in the steel.)

As described above, although the present invention is characterized by controlling especially the globular carbides in the steel, balancing of the Cr content and the Si content in the steel, and hardenability factor (Dic), in order to more easily enhance the cold cutting capability and fatigue properties as desired, it is also necessary to control compositions of the following elements.

C: 0.45-0.70% (% Means "Mass %")

C is an essential element in the steel for ensuring the strength after quenching and tempering. To achieve high strength after quenching and tempering and to get excellent fatigue properties in the high strength area, the content of C should be 0.45% or more, and preferably 0.48% or more. In addition, it is required that the ratio of globular carbides in the steel fall within the set range, and the amount of C satisfy the above condition. However, if the C content is too high, notching susceptibility is increased during cold shear cutting, and even insignificant defects that do not necessarily affect fatigue properties, such as, minor defects caused during transportation or drawing defects present on the surface of the steel wire, accelerate propagation of fatigue cracks around there. Therefore, the upper limit of the C content is specified at 0.70%, and preferably 0.63%.

Si: 1.9-2.5%

Si is a solubility-reinforcing element and contributes to the enhancement of strength and proof stress of the steel. If the content of Si is too low, it is not only difficult to obtain a desired strength, but it is also difficult to make the balance of the Cr content and the Si content fall within the set range. Therefore, the lower limit of the Si content is specified at 1.9% (preferably 2.0%). In the meantime, if the Si content is too high, when heat treatment is performed at a temperature above $A_3$ transformation temperature, ferrite decarbonization tends to generate on the surface of the steel material, and Si cannot easily be dissolved in the steel material. Therefore, the upper limit of the Si content is specified at 2.5% and preferably 2.2%.

Mn: 0.15-1.0%

Mn is actively involved in enhancement of quenchability in the steel and, 0.15% or more, preferably 0.20% or more of Mn is used. However, if the Mn content is too high, the quenchability is excessively increased so that it becomes difficult to set the Dic within the desired range. Therefore, the upper limit of the Mn content is specified at 1.0%, and preferably, 0.95%.

In addition, if the Mn content increases, MnS based inclusions are formed more readily, which become the start of the fracture process. Therefore, it is desirable to reduce the S content or add other sulfide forming elements (such as, Cu) to suppress the production of MnS inclusions.

Cr: 0.7-2.0%

Cr is an element for reinforcing matrix of the steel material by solid solution strengthening, and is essential for ensuring the high strength of the spring steel. Similar to Mn, Cr is effective for enhancing quenchability. To ensure such effect and to make the balance of the Cr content and the Si content fall within the set range, the Cr content should be at least 0.7%, and preferably 1.0%. However, if the Cr content is too high, globular carbides are produced more-than needed, thereby deteriorating drawing workability. Therefore, the upper limit of the Cr content is specified at 2.0%, and more preferably 1.75%.

P: 0.015% or Less (Exclusive of 0%)

P is an element which segregates prior austenite grains and embrittles the grain boundary, whereby fatigue properties are deteriorated. Although these give perfect reasons to reduce the P content as low as possible, its upper limit is specified at 0.015% for the sake of industrial productivity.

S: 0.015% or Less (Exclusive of 0%)

Similar to the P, S content should be reduced as much as possible because it is an element which segregates prior austenite grains, embrittles the grain boundary, deteriorates fatigue properties, and forms MnS together with Mn, initiating the fatigue fracture process. But again for the sake of industrial productivity, the upper limit of S is specified at 0.015%.

The above-described elements are regarded as essential in the present invention, and the remainder being Fe and inevitable impurities. For the inevitable impurities, elements that are added depending on materials, resources, manufacturing facilities, etc., may be mixed together. Among them are N: 0.01% or less (exclusive of 0%) and Al: 0.05% or less (exclusive of 0%). It is also possible to let the following elements get involved more actively.

At Least One Element Selected from the Group Consisting of V: 0.4% or Less, Ti: 0.1% or Less, and Nb: 0.1% or Less These elements are useful for enhancing hydrogen embrittlement resistance and fatigue properties of the steel. In particular, V is an element which forms fine precipitates composed of carbides and nitrides and thus, it not only enhances hydrogen embrittlement resistance and fatigue properties of the steel but also increases toughness, sag resistance, or stress by refining the grain size. To get benefits of these, the V content should be at least 0.07%. However, if the V content is too high, the amount of carbides not being dissolved in solid in the austenite phase during quenching is increased and it becomes difficult to get a predetermined strength. In addition, since the amount of retained austenite is increased, strength of the spring is deteriorated. Besides, an excessive amount of V causes nitrides to be coarse and this generates fatigue damages starting from those nitrides during use of the spring. Therefore, although V may be added, its upper limit should be 0.4%, and preferably 0.3%.

Ti is also a useful element which refines the grain size of prior austenite after quenching and tempering and enhances fatigue properties and hydrogen embrittlement of the steel. To get benefits of these effects, the Ti content should be 0.01% or more, and preferably 0.04% or more. However, because an excessive amount of Ti only forms precipitates composed of carbides more readily, the upper limit of the Ti content was specified at 0.1%.

Nb is an element which forms fine precipitates composed of carbides, nitrides, sulfides and compounds thereof and thus, enhances hydrogen embrittlement resistance of the steel and increases toughness or stress by refining the grain size. To get benefits of these effects, the Nb content should be 0.01% or more, and preferably 0.02% or more. However, if there is too much of Nb, the amount of carbides not being dissolved in solid in the austenite phase during quenching is increased and it becomes difficult to get a predetermined strength. Besides, an excessive amount of Nb causes nitrides to be coarse and this generates fatigue damages starting from those nitrides during use of the spring. Therefore, the upper limit of the Nb content should be 0.1% at most, and preferably 0.05% or less.

Cu: 0.70% or Less and/or Ni: 0.80% or Less

Cu is an element more electrochemically noble than Fe, and is useful for enhancing the corrosion resistance. In addition, it can suppress ferrite decarburization that occurs during hot rolling or heat treatment in the manufacture of springs. To get benefits of these effects, the Cu content should be 0.05% or more, and preferably 0.20% or more. Meanwhile, if an excessive amount of Cu is used, hot rolled cracks are possibly formed. Therefore, the Cu content should be suppressed to 0.70% or below and preferably 0.50% or less.

Ni is an element which is useful for increasing toughness of the quenched and tempered steel. In addition, Ni serves to suppress decarburization that occurs during heating prior to rolling or during rolling. To get benefits of these effects, the Ni contents should be 0.15% or more, and preferably 0.25% or more. However, if the Ni content exceeds 0.80%, the amount of retained austenite is increased during quenching and tempering and thus, tensile strength is deteriorated. Thus, the Ni content preferably should not be higher than 0.55%.

Another embodiment of the present invention provides a manufacturing process of the spring steel wire. In order to obtain a steel wire of which globular carbides satisfy the above-described conditions, the first thing to do is prepare a steel material that satisfies the composition requirement set forth by the present invention. Then, the steel material is hot rolled, cooled and annealed. In particular, it is important to control the cooling starting temperature after hot rolling, the cooling rate from the cooling starting temperature (temperature for placing on a Stelmor conveyor, for example) down to 700° C., and the annealing temperature after rolling.

First of all, in the present invention, the cooling starting temperature after hot rolling is set to 900° C. or higher, and preferably 910° C. In this manner, austenite crystal grains become coarse, quenchability is increased, and a supercooling structure (martensite structure) can be easily precipitated. Meanwhile, if the cooling starting temperature is too high, it is difficult to secure a predetermined amount of carbides so the temperature is desirably set to 1100° C. or lower. In addition, to set the cooling starting temperature after hot rolling to 900° C. or higher, the hot finish rolling temperature should be 920° C. or higher.

Moreover, the cooling rate of a temperature range from the cooling starting temperature (900° C. or higher) down to 700° C. is set at 10° C./sec or higher. This is because if the cooling rate in the temperature range is lower than that, too many nuclei of globular carbides are produced during the cooling process and an amount of carbides produced in a subsequent annealing process is substantially increased.

Furthermore, annealing after rolling should be carried out at a temperature range of 550° C. to 700° C. In general, the higher the annealing temperature and the longer the annealing process, the better globular carbides grow. In the present invention, the annealing temperature was set to 550° C. or higher, and preferably 580° C. or higher. In so doing, a sufficient amount of carbides can be ensured at the time of the annealing process although a certain amount of carbides might have been reduced during quenching and, at the same time, a steel material that precipitated a supercooling structure can be softened sufficiently, whereby breakage of the wire during a subsequent drawing process or a shaving process can be prevented. On the other hand, if the annealing temperature exceeds 700° C. and gets close to $Ac_3$ transformation temperature, it becomes apparent that carbides are globularized and become coarse and as a result, the cold cutting capability is readily deteriorated. Therefore, the annealing should be performed preferably at 680° C. or lower. In addition, to ensure a sufficient amount of carbides, it is preferable to keep the steel material at the above-described temperature range for 1-4 hours.

From the viewpoint of ensuring carbides in the steel that amounts to (0.1×C content in the steel) at the least, heat treatment is preferably carried out at a temperature range of 850° C. to 1050° C. for 1-5 minutes prior to drawing. Similarly, quenching is preferably carried out at a temperature range of 850° C. to 1050° C. for 1-5 minutes after drawing.

The present invention does not necessarily specify other manufacturing conditions. This means that commonly employed conditions may be employed for heating billets in the hot rolling process or for finish rolling. In addition, between annealing and wire drawing, other commonly employed processes such as acid pickling, lime coating treatment, shaving, lead patenting (heat treatment prior to drawing), surface coating treatment and the like may be carried out.

The spring steel wire of the present invention having excellent cold cutting capability and fatigue properties can be advantageously used for the manufacture of springs used in automotive industry, industrial machinery application, etc. Especially, it is optimal for the manufacture of valve springs of the internal combustion engines or clutch springs, brake springs, stabilizers, torsion bars, and suspension springs of automobiles.

In the following, the present invention is illustrated in detail with Examples, which, however, do not limit the present invention. Adequate modification is allowable as far as it does not depart from the object of the present invention described above or below, and every such modification is intended to be embraced in the technical scope of the present invention.

EXAMPLES 150 kg of steels materials (No. A through R respectively) having the chemical compositions as shown in Table 1 were melted in a small vacuum furnace, hot forged in a 155 mm×155 mm billet, and subjected to hot rolling, and steel rods each having a diameter of 10.0 mm were produced. Then, the steel rods were subjected to annealing at a temperature indicated in Table 2 for 2 hours, followed by wire drawing, quenching and tempering by the following process 1 or process 2, thereby obtaining a wire with a diameter of 7.0 mm. The drawn wire was then subjected to an oil tempering process at a tempering temperature of 430° C. or higher to obtain tensile strength of 2000 MPa or higher.

Process 1: Annealing→Acid Pickling→Surface Coating treatment→Drawing process→Quenching and Tempering Process 2: Annealing→Acid Pickling→Lime Coating Treatment→Shaving→Heat Treatment Prior to Drawing (Lead Patenting, etc.)→Acid Pickling with HCl→Surface Coating Treatment→Drawing Process→Quenching and Tempering Using the steel wires thusly obtained, the following properties inclusive of the shape of globular carbides, tensile strength, cold cutting capability and fatigue strength were evaluated and/or measured.

[Evaluation of the Shape of Globular Carbides]

<Measurement of Ratio of Globular Carbides>

To observe a cross section perpendicular to the axial direction of each steel wire, the steel wires were embedded in a resin. Then, regarding their surface layers (0.1 mm deep), D/8 (D: diameter of steel material) and D/4, arbitrary 10 visual fields of each were observed by SEM. Pictures were taken by using a ×2000 magnifications, and images of the globular carbides (aspect ratio a/b being 2 or less, where a is major axis of carbide and b is a minor axis of carbide) seen from a total of 30 visual fields were analyzed by a computer. They were distinguished from the matrix structure, and ratios (area %) of the globular carbides in the steel were obtained.

<Measurement of Average Particle Size of Globular Carbides>

A particle size [$\sqrt{(ab)}$, where a is major axis of carbide and b is a minor axis of carbide] of the respective globular carbides was measured from 30 visual fields in total. Then, these measurements from 30 visual fields were averaged as an average particle size of the globular carbides.

<Measurement of Cr Content Forming Globular Carbides>

0.4-0.5 g (mass) of steel wire samples were cut from the steel wires, and carbides were collected according to the electrolyte extraction of residue. In detail, the samples were immersed in an electrolyte (ethanol solution containing 10 mass % of acetyl acetone), and 100 mA current was impressed thereto for five hours, whereby parent metal iron (Fe) was electrolyzed and precipitates of the steel existing in the electrolyte were collected as residual. As for a filter for collecting the residual, a mesh filter having a diameter of 0.1 μm was used.

In addition, in case of the steel material containing AlN, MnS, Cr-based carbides ($Cr_3C$, $Cr_7C_3$, $Cr_{23}C_6$) and Ti in its residual extract, Ti-based carbide, Ti-based sulfide, Ti-based or compounds thereof are contained additionally.

The residual thusly obtained was subjected to a solution treatment, and the Cr content was measured by ICP emission spectrometry. This Cr content measurement was designated as the Cr content forming globular carbides. Using the 10 samples per test number in the following Table 2, Cr contents forming globular carbides were measured and averaged.

[Measurement of Tensile Strength]

Using the steel wire (length: 400 mm) (Test pieces of JIS Z 2201 No. 3), a tensile test was conducted following the procedure of JIS Z 2241 to measure tensile strength of each.

[Evaluation of Cold Cutting Capability]

The steel wires were cut 2000 times by cold wire shear at regular intervals of 650 mm, and a shear cut crack generation rate, a cross section crack generation rate and a burr generation rate were examined, respectively.

[Measurement of Fatigue Strength]

The steel wires of 650 mm in length were subjected to Nakamura's rotation bending fatigue test. After changing the load/stress, fatigue strength of was measured 10,000,000 cycles. When the fatigue strength was 800 MPa or greater, it was evaluated as having good fatigue strength.

The test results are shown in Table 2. The fatigue strength could not be measured in A6 and L1 since no shaving and drawing processes were performed (A6) and quench cracks were generated (L1).

TABLE 1

| Steel Piece | Cehmical Composition (mass %)※ | | | | | | | | | | | Dic | [Cr] + [Si] | [Cr]/[Si] |
|---|---|---|---|---|---|---|---|---|---|---|---|---|---|---|
| No. | C | Si | Mn | Ni | Cr | V | Ti | Cu | Nb | P | S | [mm] | [mass %] | [—] |
| A | 0.61 | 2.23 | 1.00 | — | 1.75 | — | — | — | — | 0.013 | 0.012 | 356.2 | 3.98 | 0.785 |
| B | 0.60 | 2.06 | 0.51 | — | 1.75 | 0.310 | — | — | — | 0.005 | 0.009 | 322.4 | 3.81 | 0.850 |
| C | 0.61 | 2.05 | 0.95 | 0.26 | 1.02 | 0.105 | — | — | — | 0.006 | 0.003 | 282.2 | 3.07 | 0.498 |
| D | 0.47 | 2.10 | 0.18 | 0.70 | 1.21 | — | 0.080 | 0.50 | — | 0.003 | 0.004 | 123.7 | 3.31 | 0.576 |
| E | 0.68 | 2.23 | 0.36 | 0.72 | 1.98 | 0.330 | — | — | 0.050 | 0.013 | 0.009 | 417.5 | 4.21 | 0.888 |
| F | 0.46 | 1.91 | 0.45 | — | 1.13 | — | — | — | 0.041 | 0.012 | 0.013 | 116.2 | 3.04 | 0.592 |
| G | 0.52 | 1.90 | 0.25 | 0.55 | 1.78 | — | — | — | — | 0.008 | 0.007 | 153.3 | 3.68 | 0.937 |
| H | 0.46 | 1.92 | 0.36 | — | 1.21 | — | — | — | — | 0.010 | 0.005 | 107.7 | 3.13 | 0.630 |
| I | 0.61 | 1.99 | 0.91 | — | 0.15 | — | — | — | — | 0.008 | 0.003 | 85.8 | 2.14 | 0.075 |
| J | 0.41 | 1.80 | 0.18 | 0.51 | 1.09 | 0.160 | 0.070 | 0.21 | — | 0.010 | 0.012 | 108.4 | 2.89 | 0.606 |
| K | 0.60 | 2.12 | 0.71 | — | 2.05 | 0.320 | 0.070 | — | — | 0.008 | 0.003 | 469.5 | 4.17 | 0.967 |
| L | 0.60 | 1.95 | 0.77 | 0.60 | 1.85 | 0.075 | 0.050 | 0.50 | — | 0.005 | 0.004 | 456.5 | 3.80 | 0.949 |
| M | 0.65 | 2.07 | 0.85 | 0.54 | 0.95 | — | 0.070 | 0.52 | — | 0.006 | 0.004 | 282.9 | 3.02 | 0.459 |
| N | 0.58 | 2.33 | 0.24 | 0.44 | 2.08 | — | — | — | — | 0.007 | 0.003 | 197.4 | 4.41 | 0.893 |

TABLE 1-continued

| Steel Piece | Cehmical Composition (mass %)※ | | | | | | | | | | | Dic | [Cr] + [Si] | [Cr]/[Si] |
|---|---|---|---|---|---|---|---|---|---|---|---|---|---|---|
| No. | C | Si | Mn | Ni | Cr | V | Ti | Cu | Nb | P | S | [mm] | [mass %] | [—] |
| O | 0.51 | 1.92 | 0.74 | — | 1.02 | — | — | — | — | 0.005 | 0.006 | 159.9 | 2.94 | 0.531 |
| P | 0.43 | 2.01 | 0.54 | — | 1.54 | — | — | — | — | 0.006 | 0.003 | 165.3 | 3.55 | 0.766 |
| Q | 0.48 | 1.85 | 0.65 | 0.75 | 1.25 | 0.165 | — | 0.28 | — | 0.004 | 0.008 | 289.2 | 3.10 | 0.676 |
| R | 0.61 | 2.01 | 0.21 | 0.77 | 1.92 | — | — | 0.65 | — | 0.005 | 0.005 | 223.9 | 3.93 | 0.955 |

※Remainder is Fe and inevitable imprities

TABLE 2

| Test No. | Steel Piece No. | Process* | Temp until Cooling Starting after Hot-Rolling [° C.] | Cooling Rate from Cooling Starting Temp up to 700° C. [C/sec] | Annealing Temperature after Hot-Rolling [° C.] | Heat Treatment Temperature prior to drawing [° C.] | Quenching Temperature [° C.] | Average Particle Size of Carbides [μm] |
|---|---|---|---|---|---|---|---|---|
| A1 | A | 1 | 920 | 10 | 640 | — | 930 | 0.28 |
| A2 | A | 2 | 880 | 5 | 705 | 880 | 920 | 0.89 |
| A3 | A | 2 | 870 | 12 | 680 | 930 | 915 | 0.25 |
| A4 | A | 2 | 920 | 5 | 680 | 920 | 900 | 0.33 |
| A5 | A | 2 | 950 | 12 | 720 | 920 | 910 | 1.05 |
| A6 | A | 2 | 950 | 15 | 530 | — | — | — |
| B1 | B | 1 | 930 | 11 | 620 | — | 910 | 0.38 |
| B2 | B | 1 | 900 | 12 | 690 | — | 940 | 0.71 |
| C1 | C | 2 | 980 | 15 | 600 | 890 | 900 | 0.15 |
| C2 | C | 1 | 1000 | 20 | 660 | — | 925 | 0.35 |
| D1 | D | 1 | 1050 | 10 | 650 | — | 930 | 0.12 |
| D2 | D | 1 | 900 | 15 | 680 | — | 910 | 0.25 |
| D3 | D | 2 | 850 | 2 | 710 | 900 | 900 | 1.14 |
| E1 | E | 1 | 950 | 10 | 640 | — | 900 | 0.54 |
| E2 | E | 2 | 1000 | 20 | 700 | 910 | 910 | 0.62 |
| E3 | E | 2 | 880 | 8 | 725 | 930 | 920 | 1.05 |
| F1 | F | 1 | 920 | 10 | 600 | — | 930 | 0.16 |
| F2 | F | 1 | 850 | 15 | 730 | — | 900 | 1.10 |
| G1 | G | 1 | 910 | 10 | 700 | — | 880 | 0.88 |
| H1 | H | 1 | 890 | 12 | 690 | — | 900 | 0.20 |
| H2 | H | 2 | 930 | 12 | 700 | 920 | 900 | 0.15 |
| I1 | I | 1 | 920 | 15 | 600 | — | 910 | 0.10 |
| J1 | J | 1 | 920 | 20 | 620 | — | 920 | 0.20 |
| K1 | K | 2 | 920 | 18 | 680 | 920 | 940 | 1.21 |
| K2 | K | 2 | 920 | 15 | 720 | 930 | 940 | 1.58 |
| L1 | L | 1 | 950 | 15 | 680 | — | 910 | — |
| M1 | M | 1 | 945 | 18 | 680 | — | 925 | 0.15 |
| N1 | N | 2 | 920 | 12 | 680 | 945 | 920 | 1.45 |
| O1 | O | 2 | 915 | 19 | 680 | 920 | 915 | 0.22 |
| P1 | P | 2 | 920 | 20 | 650 | 940 | 900 | 0.25 |
| Q1 | Q | 2 | 930 | 15 | 600 | 930 | 920 | 0.88 |
| R1 | R | 2 | 920 | 13 | 680 | 925 | 915 | 1.45 |

| Test No. | Volume Ratio of Carbides/C in Steel | Cr in Carbides/Cr in Steel | Tensile Strength [MPa] | Crack Generation Ratio during Cold Shear Cutting [%] | Cross-Sectional Crack Generation Ratio [%] | Burr Generation Ratio during Cold Shearing [%] | Fatigue Strength [MPa] |
|---|---|---|---|---|---|---|---|
| A1 | 0.96 | 0.058 | 2278 | 0 | 0 | 0 | 886 |
| A2 | 3.15 | 0.550 | 2205 | 0.3 | 0 | 0 | 868 |
| A3 | 3.05 | 0.380 | 2212 | 0.2 | 0 | 0 | 860 |
| A4 | 3.20 | 0.430 | 2185 | 0.2 | 0 | 0 | 850 |
| A5 | 3.30 | 0.440 | 2142 | 0.3 | 0.1 | 0 | 835 |
| A6 | — | — | — | — | — | — | — |
| B1 | 0.78 | 0.026 | 2212 | 0 | 0 | 0 | 861 |
| B2 | 2.21 | 0.210 | 2188 | 0 | 0 | 0 | 841 |
| C1 | 0.56 | 0.011 | 2125 | 0 | 0 | 0 | 821 |
| C2 | 1.85 | 0.062 | 2081 | 0 | 0 | 0 | 802 |
| D1 | 0.08 | 0.006 | 2154 | 0 | 0 | 0 | 840 |
| D2 | 0.54 | 0.080 | 2142 | 0 | 0 | 0 | 835 |
| D3 | 1.54 | 0.140 | 2031 | 0.9 | 0 | 0 | 801 |
| E1 | 1.40 | 0.012 | 2268 | 0 | 0 | 0 | 872 |
| E2 | 1.60 | 0.038 | 2278 | 0 | 0 | 0 | 882 |
| E3 | 3.20 | 0.410 | 2102 | 0.2 | 0.1 | 0 | 825 |
| F1 | 1.20 | 0.007 | 2054 | 0 | 0 | 0 | 793 |
| F2 | 4.10 | 0.480 | 1985 | 0.5 | 0 | 0 | 775 |
| G1 | 2.40 | 0.330 | 2141 | 0 | 0 | 0 | 835 |

TABLE 2-continued

| | | | | | | | |
|---|---|---|---|---|---|---|---|
| H1 | 0.09 | 0.010 | 2063 | 0 | 0 | 0.01 | 809 |
| H2 | 0.08 | 0.008 | 2045 | 0 | 0 | 0.01 | 800 |
| I1 | 0.05 | 0.001 | 1988 | 0 | 0 | 0.02 | 766 |
| J1 | 0.07 | 0.004 | 1942 | 0 | 0 | 0 | 755 |
| K1 | 3.60 | 0.540 | 2182 | 1.2 | 0.5 | 0 | 855 |
| K2 | 3.40 | 0.560 | 2141 | 2.4 | 0.6 | 0 | 843 |
| L1 | — | — | — | — | — | — | — |
| M1 | 0.12 | 0.020 | 2054 | 0 | 0 | 0 | 800 |
| N1 | 3.30 | 0.350 | 2165 | 0.2 | 0 | 0 | 840 |
| O1 | 0.58 | 0.010 | 1985 | 0 | 0 | 0 | 770 |
| P1 | 0.48 | 0.150 | 1905 | 0 | 0 | 0 | 745 |
| Q1 | 2.20 | 0.080 | 1988 | 0 | 0 | 0 | 775 |
| R1 | 2.85 | 0.380 | 2142 | 0.2 | 0.1 | 0 | 835 |

*indicates processes after annealing. 1: Annealing → Acid Pickling → Surface Coating treatment → Drawing process → Quenching and Tempering Treatment; and 2: Annealing → Acid Pickling → Lime Coating Treatment → Shaving → Heat Treatment Prior to Drawing (Lead Patenting, etc.) → Acid Pickling with HCl → Surface Coating Treatment → Drawing Process → Quenching and Tempering Treatment From Table 1 and Table 2, the following conclusions can be made (Numbers hereinafter refer to test numbers in Table 2).

Steel wires satisfying the requirement set by the present invention show excellent cold cutting capability, high strength and fatigue properties. However, steel wires that do not satisfy the requirement set by the present invention have poor cold cutting capability, suffer from cracks during cold shear cutting, cracks in the longitudinal direction from an end section and burr, and show deteriorated fatigue properties.

In detail, in case of A2-A5, D3, E3, and F2, since their manufacturing conditions were deviated from the requirement, globular carbides could not be formed in the desired shape, and cracks were generated during cold shear cutting. In addition, in case of A6, since its annealing temperature after rolling was too low, shaving and drawing processes could not be carried out.

In case of H1, H2, I1-K1, N1, and R1, since their compositions did not satisfy the requirement, globular carbides could not be formed in the desired shape and suffered from at least one of cracks during cold shear cutting, cracks in the longitudinal direction from an end section, burr, and poor fatigue strength.

In case of L1, since its Dic exceeded the upper limit, quench cracks occurred during quenching and tempering. Moreover, in case of K2, since its manufacturing conditions and composition were deviated from the requirement, globular carbides could not be formed in the desired shape and suffered from cracks during cold shear cutting and cracks in the longitudinal direction from an end section.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A spring steel wire, comprising the following composition:

C: 0.45-0.70% ("%" herein means "mass %"),

Si: 1.9-2.5%,

Mn: 0.15-1.0%, and

Cr: 1.0-2.0%, with the proviso that Cr+Si: 3.5% or more, and Cr/Si: 0.95 or less;

wherein:

P: 0.015% or less (exclusive of 0%);

S: 0.015% or less (exclusive of 0%);

wherein the metallic structure of the steel obtained from said composition satisfies:

an average globular carbide particle size with aspect ratio (a/b, a: major axis of carbide, b: minor axis of carbide) being 2 or less [√(ab)]: 1.0 μm or less;

a ratio (area %) of the globular carbide in the steel: (0.1 to 3)×amount (mass %) of C in the steel;

an amount (mass %) of Cr in the form of Cr carbide in the composition: [0.006×amount (mass %) of Cr in the steel] to [0.4×amount (mass %) of Cr in the steel];

tensile strength: 2100 MPa or more; and hardenability factor (Dic) represented by the following formulas (1)-(3): 110 mm≤Dic≤450 mm, in the case where the C content is not less than 0.45% nor greater than 0.55%, $$Dic = 25.4 \times (0.171 + 0.001[C] + 0.265[C]^2) \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]) \quad (1)$$

in the case where the C content is greater than 0.55% but not greater than 0.65%, $$Dic = 25.4 \times (0.115 + 0.268[C] - 0.038[C]^2) \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]), \text{ and} \quad (2)$$

in the case where the C content is greater than 0.65% but not greater than 0.70%, $$Dic = 25.4 \times (0.143 + 0.2[C] \times (3.3333[Mn] + 1.0) \times (1.0 + 0.7[Si]) \times (1.0 + 0.363[Ni]) \times (1.0 + 2.16[Cr]) \times (1.0 + 0.365[Cu]) \times (1.0 + 1.73[V]) \quad (3)$$

(in which, [C], [Mn], [Si], [Ni] [Cr], [Cu], and [V] represent an amount (mass %) of each element in the steel).

2. The spring steel wire as set forth in claim 1, further comprising (in mass %) at least one element selected from a group consisting of V: 0.4% or less (exclusive of 0%), Ti: 0.1% or less (exclusive of 0%) and Nb: 0.1% or less (exclusive of 0%).

3. The spring steel wire as set forth in claim 1 further comprising (in mass %) at least one element selected from a group consisting of Cu: 0.70% or less (exclusive of 0%) and Ni: 0.80% or less (exclusive of 0%).

4. A manufacturing process of the spring steel wire as set forth in claim 1, wherein the process comprises the steps of:

hot rolling a steel material that satisfies the composition set forth in claim 1;

setting a cooling starting temperature after hot rolling to 900° C. or higher, and cooling the steel material from the cooling starting temperature down to 700° C. at a cooling rate of 10° C./sec or higher; and annealing the steel material at a temperature range of 550° C. to 700° C.

5. The spring steel wire as set forth in claim 1, wherein C is present in the composition in an amount of from 0.48 to 0.63 mass %.

6. The spring steel wire as set forth in claim 1, wherein Si is present in the composition in an amount of from 2.0 to 2.2 mass %.

7. The spring steel wire as set forth in claim 1, wherein Mn is present in the composition in an amount of from 0.20 to 0.95 mass %.

8. The spring steel wire as set forth in claim 1, wherein Cr is present in the composition in an amount of from 1.0 to 1.75 mass %.

9. The spring steel wire as set forth in claim 1, wherein the amount of Cr in the form of Cr carbide in the composition is 0.006×amount of Cr in the steel to 0.3×amount of Cr in the steel.

10. The spring steel wire as set forth in claim 1, wherein 115 mm≤Dic≤420 mm.

11. A process for preparing the spring steel wire of claim 1, which comprises:

hot rolling a steel composition comprising:

C: 0.45-0.70% ("%" herein means "mass %"),

Si: 1.9-2.5%,

Mn: 0.15-1.0%, and

Cr: 1.0-2.0%, with the proviso that Cr+Si: 3.5% or more, and Cr/Si: 0.95 or less;

wherein:

P: 0.015% or less (exclusive of 0%);

S: 0.015% or less (exclusive of 0%);

setting a cooling starting temperature after hot rolling to 900° C. or higher, and cooling the steel material from the cooling starting temperature down to 700° C. at a cooling rate of 10° C./sec or higher; and annealing the steel material at a temperature range of 550° C. to 700° C.

* * * * *